US007406732B2

(12) United States Patent
Ramaiah

(10) Patent No.: US 7,406,732 B2
(45) Date of Patent: Aug. 5, 2008

(54) ARM HEADREST

(76) Inventor: Anita Ratan Ramaiah, 11159 E. Sorrel La., Scottsdale, AZ (US) 85259-5778

( * ) Notice: Subject to any disclaimer, the term of this patent is extended or adjusted under 35 U.S.C. 154(b) by 84 days.

(21) Appl. No.: 11/164,474

(22) Filed: Nov. 23, 2005

(65) Prior Publication Data

US 2007/0113348 A1 May 24, 2007

Related U.S. Application Data

(60) Provisional application No. 60/522,949, filed on Nov. 23, 2004.

(51) Int. Cl.
*A61G 7/07* (2006.01)

(52) U.S. Cl. ..... 5/636; 5/637; 5/640; 5/622

(58) Field of Classification Search ..... 5/922, 5/622, 636, 637, 640; 128/845
See application file for complete search history.

(56) References Cited

U.S. PATENT DOCUMENTS

| | | | | |
|---|---|---|---|---|
| 4,679,263 | A * | 7/1987 | Honer | 5/640 |
| 5,682,632 | A * | 11/1997 | Cotroneo | 5/636 |
| 6,625,829 | B2 * | 9/2003 | Zell | 5/637 |
| 2003/0159217 | A1 * | 8/2003 | Clemons | 5/636 |

* cited by examiner

*Primary Examiner*—Michael Trettel
(74) *Attorney, Agent, or Firm*—Venable, Campillo, Logan & Meaney PC

(57) ABSTRACT

An Airway Management Apparatus (AMA) and method for aiding in airway patency/preventing airway obstruction under sedation in the supine position and other situations where tongue and jaw relaxation occurs, by maintaining the jaw thrust/chin lift position and neck extension. It is also useful when airway patency is compromised due to abnormal neuromuscular tone, redundant soft tissue or an increase in upper airway adipose tissue. The ARM Headrest includes lateral extensions which house the foam wedges to provide the mechanical jaw thrust maneuver when positioned under the mandibular angles. When strapped under the chin to perform the jaw thrust/chin lift maneuver, it is very effective in opening up the airway in a large population of patients who obstruct during sleep, sedation, etc. It also has a head and neck support having a partially concave and partially convex surface, respectively. The ARM headrest aids in airway patency and prevents/removes airway obstruction by providing the jaw thrust and/or chin lift maneuver thereby increasing the space between the pharyngeal wall and the base of the tongue, and by providing neck extension. The ARM Headrest adds a significant safety net in the arena of preventable respiratory depression and respiratory arrest caused by sedation in critical and non-critical settings. Undetected respiratory depression, airway obstruction, and respiratory arrest have resulted in death or hypoxic encephalopathy. This device helps to eradicate preventable airway obstruction with a simple modification of the common headrest.

4 Claims, 1 Drawing Sheet

ARM HEADREST

This application claims the benefit of U.S. Provisional Application No. 60/522,949 filed Nov. 23, 2004.

Airway management apparatus and method in the form of an extended foam headrest. This headrest has foam lateral extensions, caudally, with wedges at the end made from foam of varying density. There are optional Velcro® (also known as "hook and loop" fasteners) attachments to the underside of the headrest beneath the wedges to secure the foam wedges under the patient's mandible on either side, if needed, by being attached to the complementary Velcro® piece on the opposite wedge. A convexity can be included in this headrest just cephalad to the extensions to aid in neck extension and thus airway patency. This headrest includes size and product modifications to accommodate infants e.g. with a low headrest portion in the design, children, normal sized, and larger adults.

A modification wherein only the wedge extensions are used in other settings for the same intended purpose is included in this description.

SUMMARY

The ARM Headrest can be used for the improved airway management of patients undergoing conscious sedation, recovering from anesthesia, or in any circumstance where the airway patency is being compromised due to a reduction of the space between the pharyngeal wall and the base of the tongue caused by relaxation of the tongue and jaw. The headrest is a unit that combines the function of a headrest to prevent pressure and positional injuries under anesthesia or in other prolonged positioning conditions, with the foam wedge extensions to provide a cardinal non-invasive maneuver in airway management—the jaw thrust—by being positioned under the mandibular angle on either side. Velcro® on either side may be used to aid in maintaining the wedge in position under the mandible. This is not always required.

Neck extension is also aided by the convexity cephalad to the lateral extensions of the ARM Headrest.

It has foreseeable use in the obese patient and those suffering from sleep apnea.

DETAILED DESCRIPTION

Figure 1:
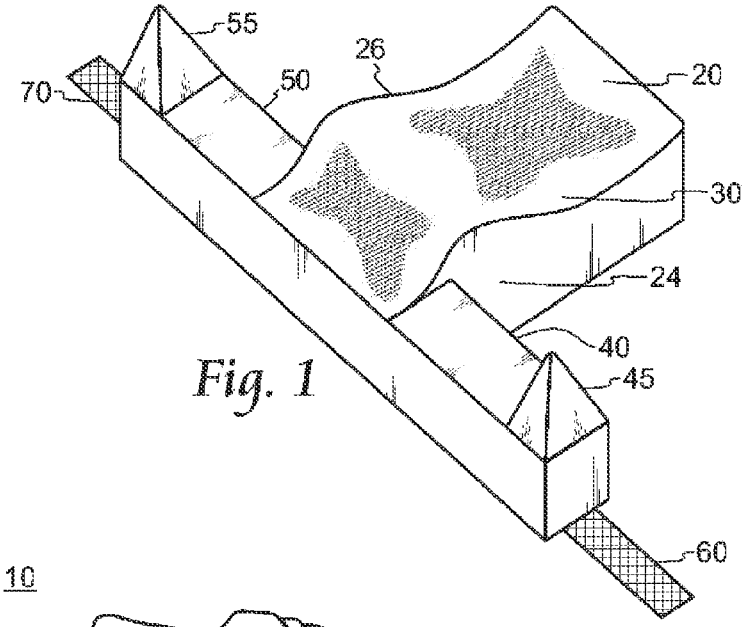
FIG. 1 is a perspective view of a preferred embodiment of the foam headrest and foam wedge extensions of the present invention.
Figure 2:
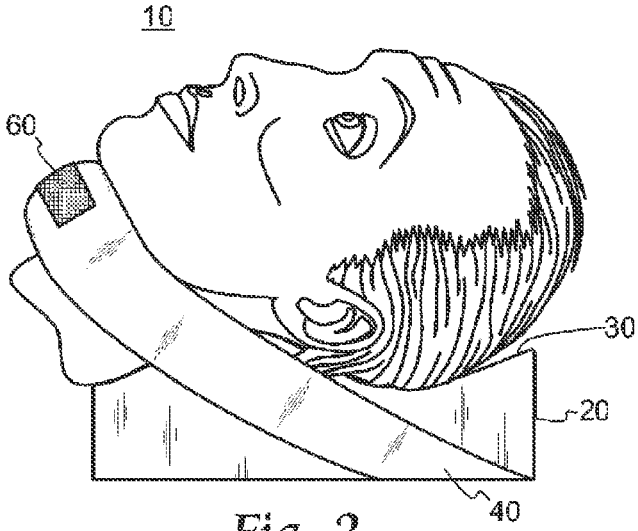
FIG. 2 is one side view of a preferred embodiment of the invention and including the positioning of a patient in reference to the foam headrest and foam wedge extensions of the present invention with the posterior aspect of the patient's head and neck depicted.
Figure 3:
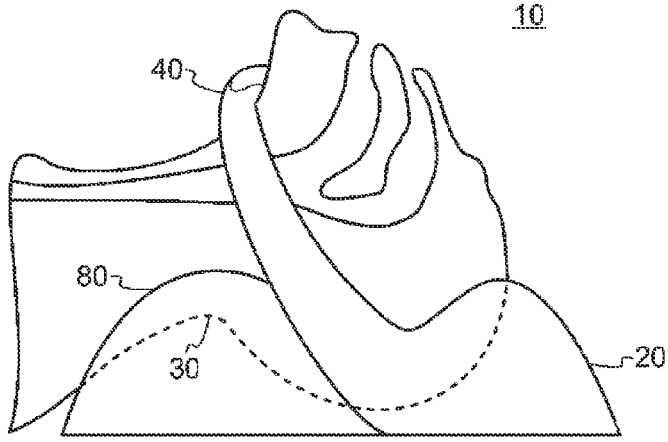
FIG. 3 is another side view of a preferred embodiment of the invention and including the positioning of a patient in reference to the foam headrest and lateral extensions of the present invention with the posterior aspect of the patient's head and neck depicted by the dashed lines.

Referring to FIGS. 1 to 3 are preferred embodiments of the invention, one preferred embodiment shown in FIG. 1 shows an airway resistance modifier headrest 10 comprising a headrest 20, having a convex neck support area 35 and a first side 24 and second side 26, and first lateral extension 40 having a first wedge 45 and second lateral extension 50 having a second wedge 55 coupled on either side to the headrest 20 to the first side 24 and second side 26, respectively. In a preferred embodiment the first lateral extension 40 and second lateral extension 50 may be attached (or coupled) to each other by at least one attachment; and as shown in FIG. 1 by a first attachment 60 and second attachment 70; more preferably the attachments may be Velcro® (that matingly couple) that are attached to the underside of the first wedge 45 and second wedge 55. FIG. 2 shows the operation of the device such that the airway resistance modifier headrest 10 is positioned with the headrest 20 under the patient's head and the convex neck support area 30 under the patent's neck causing a neck extension for the patient. The first and second wedges 45 and 55 of the first and second lateral extensions 40 and 50 provide support to the patient's chin and neck area.

FIG. 3 shows another preferred embodiment where an airway resistance modifier headrest 10 additionally comprises a nape area convexity support 80 and the first lateral extensions 40 and second lateral extensions 50 (not shown in the FIG. 2 side view) are strapped under the chin without wedges. In a preferred embodiment, wedges could also be included. The lateral extensions may be located or coupled at any side location as seen in FIGS. 1 through 3, but are most preferably located cephalad as shown in FIGS. 2 and 3.

What is claimed is:

1. An Airway Resistance Modifier Headrest comprising: a headrest having a convex neck support area and a first side and second side, a first lateral extension coupled to the first side, a second lateral extension coupled to the second side, and a first wedge and a second wedge respectively coupled, to be positioned under a mandibular angle of a patient, to the first lateral extension and the second lateral extension.

2. The Airway Resistance Modifier Headrest of claim 1 wherein the headrest, first lateral extension, the second lateral extension, the first wedge and the second wedge are foam.

3. The Airway Resistance Modifier Headrest of claim 2 further comprising at least one attachment for coupling the first lateral extension to the second lateral extension.

4. The Airway Resistance Modifier Headrest of claim 3 wherein the at least one attachment for coupling the first lateral extension to the second lateral extension are hook and loop fasteners.

* * * * *